United States Patent [19]

Oyler

[11] 4,408,987

[45] Oct. 11, 1983

[54] CIRCULAR TRAVELING GRATE MACHINE FOR PROCESS REQUIRING MINIMUM GAS LEAKAGE

[75] Inventor: John F. Oyler, Pittsburgh, Pa.

[73] Assignee: Dravo Corporation, Pittsburgh, Pa.

[21] Appl. No.: 340,977

[22] Filed: Jan. 20, 1982

[51] Int. Cl.[3] ..... F27B 9/26; F26D 3/12; C21B 7/16

[52] U.S. Cl. ..... 432/137; 266/179; 432/242

[58] Field of Search ..... 432/137, 242; 266/178, 266/179, 180

[56] References Cited

U.S. PATENT DOCUMENTS

| | | | |
|---|---|---|---|
| 3,302,936 | 2/1967 | Ban | 266/178 |
| 3,460,818 | 8/1969 | Greaves et al. | 266/179 |
| 3,655,174 | 4/1972 | Veith | 266/179 |
| 3,774,891 | 11/1973 | Plotkin et al. | 266/179 |

*Primary Examiner*—John J. Camby

*Attorney, Agent, or Firm*—Parmelee, Miller, Welsh & Kratz

[57] ABSTRACT

A traveling grate consisting of individual pallets each supported on four wheels and independently connected to continuous side walls so that the pallets can pivot down away from and back toward the continuous sidewalls as the rear wheels follow a depressed portion of the trackway in the discharging zone of a retort. The wheels travel in a tunnel which is isolated from the processing zone of the grate retort but is in fluid communication with the charging and discharging zones. The processing zones are also separated from the remainder of the retort by transverse seals formed by false windboxes. Gas leakage from the processing zone is minimized by the tunnel-encapsulation of the retort's processing zone.

10 Claims, 7 Drawing Figures

CIRCULAR TRAVELING GRATE MACHINE FOR PROCESS REQUIRING MINIMUM GAS LEAKAGE

BACKGROUND OF THE INVENTION

1. Field of the Invention

The invention is directed to circular traveling grate machines and, more particularly, it is directed to those circular traveling grate machines which require minimum gas leakage such as horizontally disposed, circular traveling grate retorts.

2. Description of the Prior Art

Circular traveling grate retorts are characterized by distinct processing zones and material charging and discharging zones. Ideally, the processing gas in each of the several processing zones is efficiently isolated from the adjacent zones to prevent gas leakage from one zone into another. It is also beneficial to isolate the supporting components of the individual pallets which make up these grates in order to insure trouble free mechanical performance. Finally it has been a continuing goal in the field of circular traveling grate retorts to provide a pallet capable of quickly and simply discharging the burden thereon after processing has been completed.

U.S. Pat. No. 3,302,936 discloses a circular traveling grate machine in which individual pallets are supported by three wheels, a pair of forward laterally disposed wheels and a single centrally disposed rear wheel. The forward wheels travel along a horizontal trackway and the rear wheel rides on a centrally located rail which drops below the horizontal plane of the trackway in order to dump the pallet. The rear wheel of each pallet travels through the processing zones and is continuously subjected to excessive heat. This results in a short working life for the rear wheel and its supporting components. In an attempt to isolate the supporting components of a pallet, U.S. Pat. No. 2,825,550 discloses a straight traveling grate in which a longitudinal seal is provided between the hood and the windbox to form a tunnel through which the wheels supporting individual pallets travel. The tunnel is provided with flexible transverse closure members which allow the pallet wheels to enter and to exit the tunnel. No consideration is given in this patent to the discharging of materials in a circular grate and the sealing problems which are attendant therewith. It has also been known to utilize false windboxes as transverse seals in traveling grates. Inert gas is injected through such windboxes in order to isolate zones in a retort. Examples of this can be examined in U.S. Pat. Nos. 3,044,756 and 4,193,862.

It is an object of the present invention to provide a circular traveling grate machine which isolates the processing zone from the remainder of the machine and provides an isolated tunnel in fluid communication with the charging and discharging zones of the retort. The support components travel through this tunnel safe from the adverse effects of contact with heated process gases.

It is also an object of this invention to provide a retort which completely encapsulates the process zone therein.

It is still another object of this invention to provide a pallet for movement along a circular trackway, each pallet mating with each immediately preceding and each succeeding pallet to form a continuous grate surface and each pallet capable of independent pivotal movement relative to the other pallets.

SUMMARY OF THE INVENTION

The invention provides a horizontally disposed, circular traveling grate retort which is particularly suitable for the recovery of volatile products from oil bearing shale. Transverse sealing with false windboxes and hood chambers isolates the several processing zones from the charging and discharging zones. These false windboxes and hoods are pressurized with an inert gas. Longitudinally, about the inner and outer circumferences of the grate's circular trackway, tunnels are formed through which the pallet wheels travel. The tunnels are in fluid communication with the charging and discharging zones which are in turn isolated from the environment external to the grate by seals formed in the respective access hoppers of each zone. In the process zones, this tunnel is formed by a seal provided between the continuous side walls of the grate and the hoods and seals provided between the side walls and the pallets and the windboxes.

The traveling grate consists of a plurality of individual pallets each supported on four wheels and independently connected to an inner and an outer continuous sidewall. The sidewalls are also independently supported by the forward pair of wheels of each pallet. The leading axle of each pallet is so connected to the sidewalls and the forward pair of wheels that in the discharging zone, as the pallet's rear pair of wheels follows the downwardly inclined trackway, the pallet pivots about its forward wheels and dumps its burden into a discharge chute.

The design of the pallet cooperates with the longitudinal seals which make up the tunnel. The leading edge of the pallet formed by the upper surface and the front face of the pallet is no farther forward than the centerline of the forward axle. The front face of the pallet tapers rearwardly at about a 15° angle. The centerline of the axle is also no higher than the bottom of the pallet. With this configuration, the pallet falls away from the bottom of the side walls without experiencing any upward lift relative to the side walls. The trailing edge of the pallet extends rearwardly beyond the rear axle and terminates in an angled face which is complementary to the leading face of the next following pallet.

DETAILED DESCRIPTION OF THE INVENTION

While this invention is directed to a circular traveling grate machine for use with a process requiring minimum gas leakage, it will become obvious to those skilled in the art of horizontally disposed circular traveling grates that the individual pallets of this invention are readily adaptable to a variety of processes in which gas leakage is not of principle concern.

Figure 1:
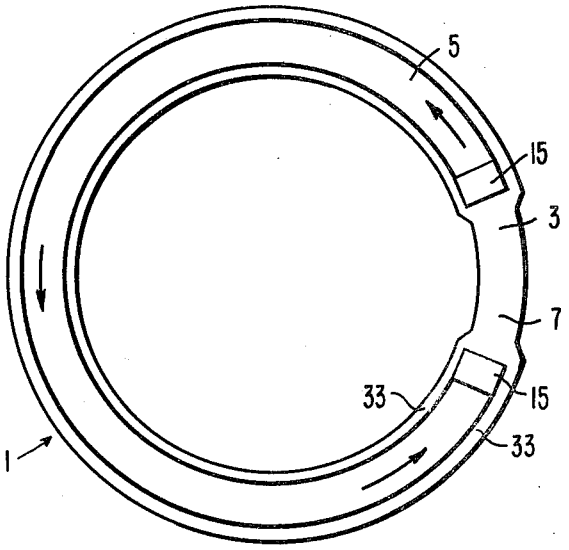
FIG. 1 is a schematic plan view of a circular traveling grate.
Figure 2:
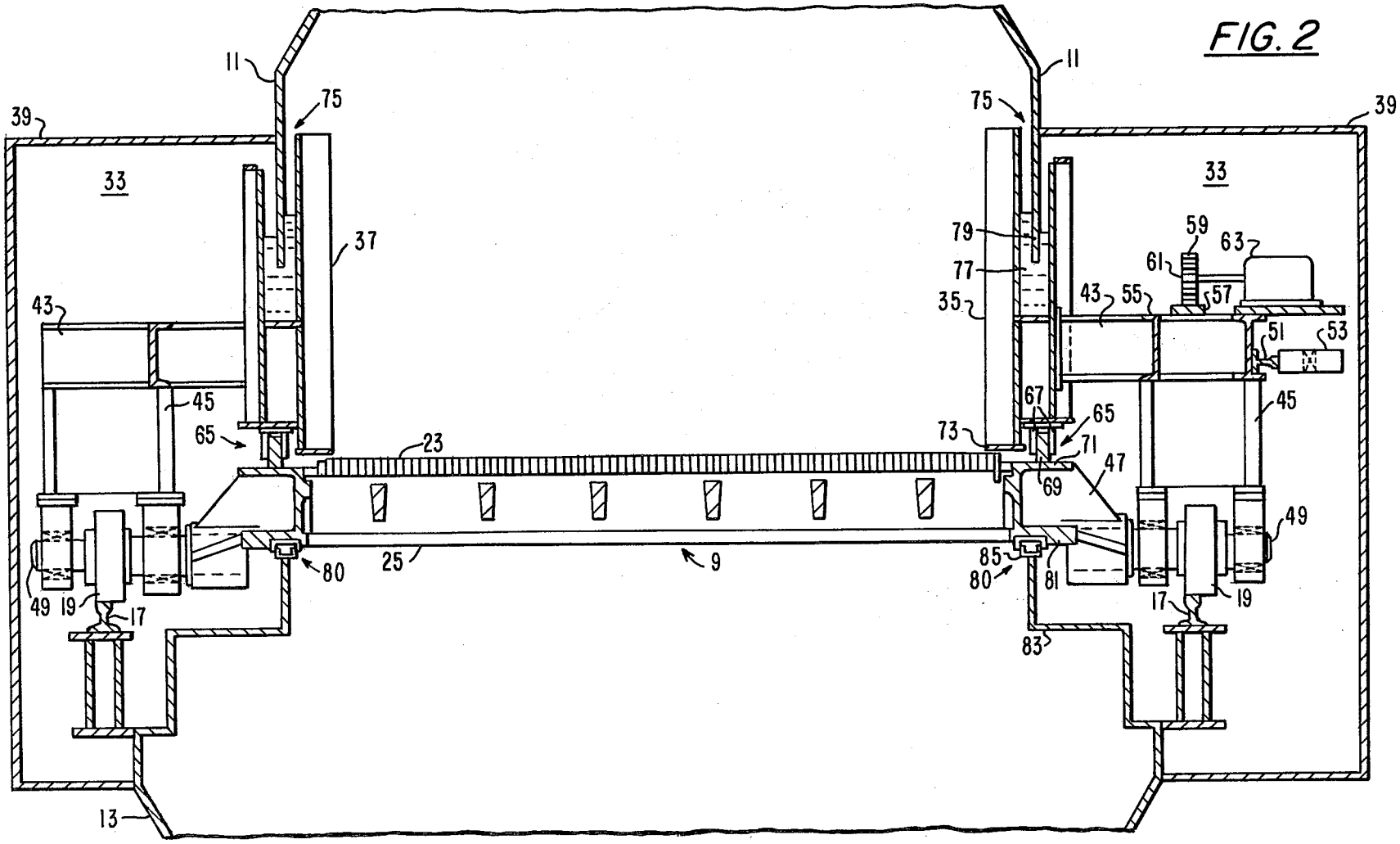
FIG. 2 is an elevational cross-section of a traveling grate incorporating the features of this invention.

Referring now to FIGS. 1 and 2, there is shown a circular traveling grate machine, generally indicated by the reference character 1. A burden of material to be processed is charged onto the traveling grate at a charging zone 3 and is conveyed through a processing zone 5. In the retorting of oil bearing shale, for example, the processing zone 5 may include several individual processing zones such as a preheating zone, an oil liberation zone, a combustion zone and a cooling zone. Once processing is completed the spent burden is removed from the grate in the discharging zone 7. The rate of processing is a function of a combination of factors including the particular type of process being effected and the physical capacity and quality of the traveling grate machine itself. The burden is carried through the various zones on a plurality of individual gas permeable pallets 9 which define a continuous grate surface. A series of hoods 11 and wind boxes 13 are disposed above and below the pallets 9 respectively and generally define the processing zone 5 where fluid is passed through the pallets and the burden thereon. The hood and windbox immediately adjacent the charging zone 3 and the discharging zone 7 from false windboxes 15 which provide transverse seals separating the aforementioned zones from the processing zone 5.

The fluid flow in the processing zone 5 is at a predetermined pressure which ensures that an even flow of fluid through the burden is effected. A continuous flow of inert gas is maintained in the false windboxes 15 in order to inhibit any escape flow of fluid out from the processing zone 5. The inert gas flow is at a pressure which is no less than and preferably greater than the pressure of the fluid flow in the processing zone 5 so that any gas flow leakage will be from the inert gas in the false windboxes 15 into the processing zone 5 rather than vice versa.

The gas permeable pallets 9 extend across the windboxes 13 and travel on rails 17 which define a substantially continuous circular trackway about a horizontal plane. As can be more clearly seen in FIGS. 2 and 4, each pallet 9 has a pair of forward or leading wheels 19 and a pair of rear or trailing wheels 21 and 21' which ride along the trackway 17. The pallet 9 has an upper surface 23 and a lower surface 25 which are gas permeable, a leading face 29 which tapers rearwardly at about a 15° angle and a trailing face 31 which also tapers rearwardly and terminates in an angled face which is complementary to the leading face of the next following pallet. The pallet 9 is a truncated sector in shape with the leading face 29 and the trailing face 31 aligned with radii extending from the center of the trackway 17. The significance of the taper of the leading and trailing faces of the pallets as well as the exact location of the wheels with respect thereto will be more fully described hereinafter.

Returning to FIG. 2, it can be seen that the wheels of each pallet 9 travel on rails 17 which are substantially isolated from the process gas of the processing zone 5 by the tunnels 33. (Only the forward wheels 19 of a pallet are shown). As can be seen in FIG. 1, the tunnels 33 along both the inner and outer circumference of the trackway 17 are in fluid communication with the charging zone 3 and the discharging zone 7 and together therewith form a substantially enclosed and isolated chamber. This tunnel-chamber so formed is filled with an inert gas which is maintained at a pressure greater than the pressure of the process gas in the processing zone 5 so that any leakage between the processing zone 5 and the tunnel 33 will consist of inert gas from the tunnel into the processing zone 5. The tunnels 33 are defined by longitudinal sealing means consisting of the inner continuous side wall 35 and the outer continuous side wall 37 disposed between the hoods 11 and the pallets 9 and the sealing means between the afore-mentioned components, the windboxes 15, the pallets 9 and the sealing means therebetween, and an enclosure member 39 which extends from the hoods 11 to the windboxes 13 and encloses the trackway 17 on both sides of the pallets 9. The tunnels 33 in conjunction with the charging and discharging zones together with the false windboxes 15 serve to essentially encapsulate the processing zone 5.

The encapsulation of the processing zone practically eliminates the escape of volatile products and by-products into the environment. Moreover, because the mechanical components of the traveling grate retort are for the most part isolated from the processing gas by the tunnel, the ever present danger of explosion when liberating volatile products is substantially reduced.

Each pallet 9 is supported in part by the forward wheels 19 which are aligned along a single radius "R" of the circular trackway 14. Additionally, both of the continuous side walls 35 and 37 are mounted on and supported by the forward wheels 19. The manner in which the continuous sidewalls and the pallets are supported by the wheels 19 will be explained with particular reference to the inner continuous side wall 35 as illustrated in FIG. 2. A forward casting 47 extends from the pallet 9 and supports axle 49 on which the wheel 19 is mounted for rotation by means of an appropriate bearing system. A guide beam 43 extends from the outside surface of side wall 35 and a support member 45 depends downwardly from beam 43. The support member 45 is mounted by means of an appropriate bearing system onto axle 49 so as to straddle wheel 19. The continuous side walls 35 and 37 and the pallets 9 travel about the circular trackway 17 as an integral unit and define a burden bearing and containing surface. The entire grate could for example, consist of approximately one hundred pallets. The continuous side walls 35 and 37 are each supported by the axle 49 extending from the casting 47 of each individual pallet. A continuous guide rail 51 extends horizontally from the guide beam 43 and rides against a series of spaced guide rollers 53 in order to provide lateral stability to the moving grate. The pallets and side walls can be driven by any of several conventional drive means. For example, the supper surface 55 of the guide beam 43 may be provided with a continuous rack 57 which is engaged by the teeth 59 of drive gear 61. Power can be provided to the drive gear 61 by an electric motor 63. The entire drive system may also be enclosed within the tunnel 33 because the tunnel is filled with inert gas, or the motor 63 can be located outside of the tunnel with only the drive shaft extending through enclosure member 39 to engage the drive gear. Another example is a friction drive typically used on circular coolers.

Three sealing means together with the enclosure member 39 form the tunnel 33. The first sealing means 65 is a static, mechanical seal between a bottom edge of the side wall 35 and the upper pallet surface 23. The seal 65 illustrated herein comprises a pair of parallel flanges 67 depending from the bottom edge of the side wall 35, and sealing member 69 fixedly mounted to a continuous nonpermeable surface portion 71 of the pallet's upper surface 23. The sealing member 69 is removably engaged by the parallel flanges 67 and forms a friction fit therewith which is substantially air tight. The sealing member 69 is free to move a limited distance vertically to ensure an unrestrained contact between the side wall 35 and the upper pallet surface 23. The mechanical sealing means 65 is located outside of the bottom edge 73 of the continuous side wall which is abutting the gas permeable upper pallet surface. This particular arrangement isolates the mechanical sealing means 65 from the burden thus inhibiting interference by the burden with the seal.

The second seal 75 between the hoods 11 and the side walls is a conventional water trough seal in which a continuous channel 77 in the upper portion of the wall is filled with a fluid such as water and a continuous flange 79 depending down from the hoods 11 is partially submerged in the fluid.

The third seal 80 is a mechanical seal between the windboxes 13 and a non-permeable lower surface portion 81 of the pallet. A continuous member 83 extends upwardly from the windboxes 13 and supports a sealing member 85 which rests against the non-permeable lower surface portion 81. The sealing member 85 may be biased to provide an upward force against the bottom of the pallet. As the pallets travel about the trackway, they slide over the sealing member 85 thus providing a constant friction seal therebetween.

The above described seals cooperate with the design of the pallet and the trackway in order to facilitate the discharging of the burden from the grate. The encapsulation tunnels 33 and false windboxes 15 retain the processing gas within the processing zone even while the continuous grate surface defined by the pallets is temporarily interrupted when the pallets discharge their burden.

Figure 3:
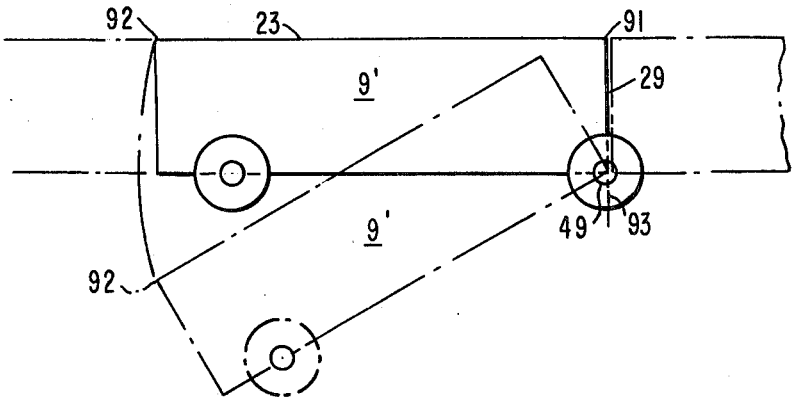
FIG. 3 is a side elevation of a pallet illustrating design considerations of this invention.

As will be hereinafter more fully explained, when each pallet travels through the discharging zone of the circular traveling grate machine 1, it pivots by means of its forward axles 49 to allow the spent burden thereon to slide from the pallet into a discharge hopper. The inventive configuration of the individual pallet and its unique relationship with the continuous side walls as well as the pallets immediately preceding and succeeding it are central to the maintenance of the mechanical seals 80 and the static seal 65. Turning to FIG. 3, the design requirements of the instant pallet will first be explained so that those skilled in the art will readily recognize the particular benefits of the preferred embodiment. The plurality of individual pallets form a continuous grate surface through the charging and processing zones. However, while traversing the discharging zone, each of the individual pallets pivots about its forward axle to dump its spent burden. As was previously explained, my invention utilizes a sealing means 65 between the bottom edges of the side walls 35 and 37 and the upper pallet surface 23. When the pallet pivots to dump its burden, any upward lift of the pallet surface 23 relative to the continuous side walls 35 and 37 will damage the sealing means 65. Using the rectangular pallet 9' as a model, it can be seen that the leading edge 91 of the upper surface 23 is no farther forward then the vertical axis 93 of the forward axle 49. Thus as the pallet 9' pivots into the dumping position, shown in phantom, the leading edge 91 of the pallet falls down away from the continuous side walls. Moreover, the forward face 29 of the pallet is also no farther forward than the vertical center line 93 of the axle 49, so that the forward face falls back away from the preceding pallet. Because the grate is formed by a plurality of continuous individual pallets, consideration must be given to the relationship of each individual pallet with the pallets immediately preceding and succeeding it (also shown in phantom). If the pallets were all rectangular as shown in FIG. 3 the trailing edge 92 of the pallet 9' would bind with the next following pallet and pivotal movement would be impossible unless the pallets were arranged in a spaced relationship so that a gap provided between the pallets permitted the pivotal movement. This presents the serious drawback of a grate surface which is not continuous and the obvious problems attendant therewith. The key to the design of the forward face 29 of the pallet resides in maintaining the proximity of the leading edge of one pallet with the trailing edge of the next pallet so that a continuous grate surface is maintained while providing the clearance necessary for the pallets pivotal movement. This is accomplished by ensuring that the distance between the leading axle 49 of a first pallet and any point on the leading face of the next following pallet is at least as great as the distance between the leading axle of the first pallet and that pallets trading edge 92.

Figure 4:
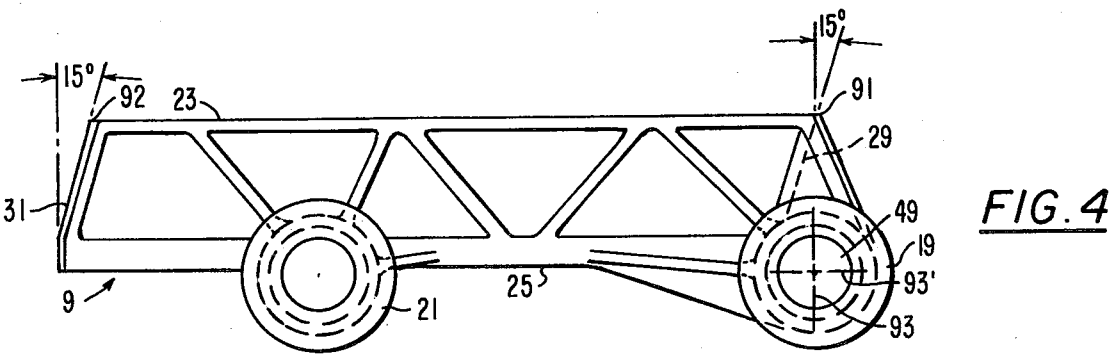
FIG. 4 is a side elevation of an individual pallet in a circular traveling grate.

Now turning to FIG. 4, it can be seen that the preferred pallet design of my invention provides a continuous grate surface. The leading edge 91 of the pallet 9 formed by the upper surface 23 and the leading face 29 is no farther forward then the vertical center line 93 of the forward axle 49. The lower pallet surface 25 is no lower than the horizontal center line 93' of the axle 49. Thus there is no upward or forward movement of any portion of the forward section of the pallet during its pivotal movement down away from the continuous side walls. To overcome the binding problem of the trailing face 31 of the pallet with the next following pallet, the leading face 29 of the pallet tapers rearwardly at an angle sufficient to provide clearance for the trailing pallet edge 92. An angle of about 15° for the taper of the forward face is satisfactory and provides the required clearance for the pivoted movement of the pallet. While it is possible to provide a pallet with a rear face perpendicular to the pallets upper surface, it is preferred that the rear face 31 taper rearwardly and terminate in an angled face which is complementary to the leading face 29. Accordingly, a continuous grate surface is formed by the plurality of individual pallets.

This configuration of the pallet allows it to pivot down away from the continuous side walls by means of its axles 49 without experiencing any upward lift relative to the sidewalls and to freely pivot down away from the next following pallet. In other words, a pallet entering the discharging zone falls down away from the side walls and the next following pallet with absolutely no upward motion at all while pivoting by means of its forward axles. The leading edge of the pallet does not rise above the plane of the upper pallet surface. This is important because of the static seal between the bottom surface of the continuous side walls and the upper pallet surface. Any motion of the pallet up through the aforementioned horizontal plane would damage the static seal or cause the pallet to bind with the side walls.

Figure 6:
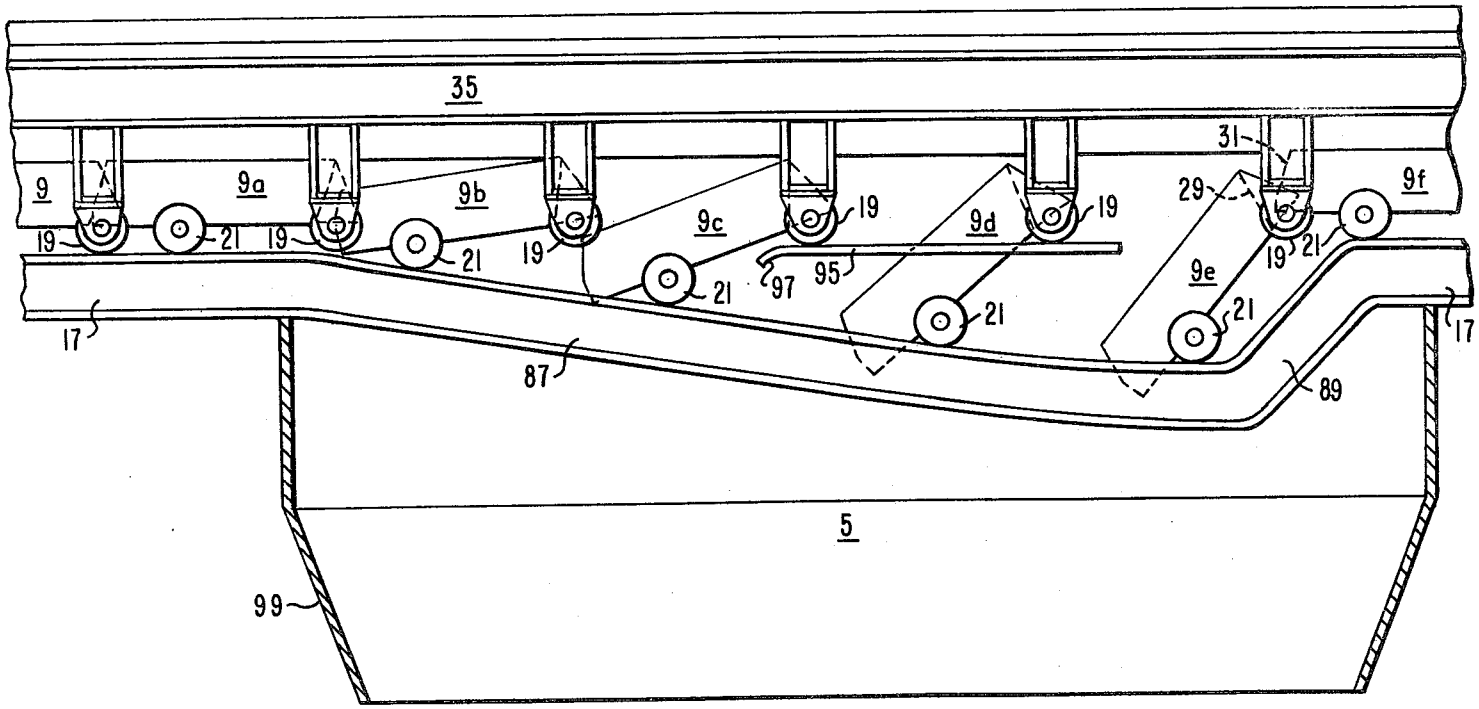
FIG. 6 is a side elevation of the material discharging zone utilizing the features of this invention.

Turning now to FIG. 6, the dumping cycle of the pallets as they traverse the discharging zone 7 is illustrated by six pallets sequentially designated by the reference characters 9a through 9f. The trackway 17 is depressed as at 87 in the discharging zone below the horizontal plane defined by the trackway of the charging zone and processing zone. The trackway gradually slopes downwardly away from the horizontal in the direction of grate travel which is indicated by the arrow. After completing its run through the discharging zone, the trackway curves upwardly, as at 89 and converges with the horizontally disposed trackway of the charging zone 3.

When traveling through the charging and processing zones the continuous side wall is supported by the axles 49 and forward wheels 19 of each pallet. With this relationship, the pallet is actually being towed along the trackway by means of the axle 49. As the pallet 9a enters the discharging zone 7, the depressed trackway 87 falls away from the forward wheels 19. The continuous side walls 35 and 37 which had heretofore been supported by the forward axles and wheels now supports the forward portion of pallet 9a. The rear wheels 21 and 21' of the pallet 9a are still traveling on the horizontal portion of the trackway and the pallet 9a remains horizontally disposed. The rear wheels 21 and 21' of the pallet 9b are beginning to travel down the depressed portion of the trackway 87. Just prior to the downward travel of the pallet 9b, the mechanical seal 80 between the windboxes 13 and the lower surface portion of the pallet must be terminated, otherwise the continuous members 83 which extend upwardly from the windboxes and support sealing members 85 would interfere with the pivotal motion of the pallets. As the rear wheels of pallet 9b begin their downward travel, the pallet 9b falls away from the continuous side walls 35 and 37, thus disengaging the first sealing means 65 between the bottom edge of the side walls and the upper pallet surface 23. The water seal between the hoods and the continuous side walls is uninterrupted through the entire discharging process. The configuration of each pallet and the importance of the pallets structure in relation to the longitudinal axis of the forward axle 49 should now be readily appreciated by those skilled in the art. Any upward movement of the pallet through the horizontal plane defined by the surface thereof is completely unacceptable and through this invention, totally eliminated.

The tunnel 33, through which the pallets' wheels traveled while the pallets passed through the processing zone 5 is in fluid communication with the discharging and charging zones. Even though the seals 65 and 80 are disengaged in the discharging zone 7, the false windboxes at either end of the processing zone provide transverse sealing of the processing zone.

Pallet 9c continues the downward pivotal movement as its rear wheels 21 and 21' ride along the depressed section of the trackway 87. A pair of leading wheel support rails 95 is placed in the horizontal plane of the trackway 17 and is supported by external structures which are not illustrated. For a portion of the travel of the pallets through the discharging zone, as at pallets 9c and 9d, the leading wheel support rails 95 provide a trackway along which the forward wheels of the pallets are supported. These rails 95 minimize the distance traveled by each pallet while supported only by the axles 41 and of course, also reduce the downward force exerted on the continuous side walls by the depending pallets. Thus the continuous side walls are supported by the maximum number of pallets at all times. If for example, the continuous side walls are mounted onto one hundred grates, the side walls would be without the support of only two or three pallets at a time. The rails 95, may be slightly, downwardly tapered as at 97 to facilitate engagement therewith by the forward wheels 19 of pallet 9c. Pallet 9d continues the downward pivoting motion as its rear wheels follow the depressed portion of the trackway. A collection hopper 99 is disposed below the depressed trackway 87. As the pivotal angle of the pallet relative to the continuous side walls reaches and exceeds the angle necessary to overcome the coefficient of friction of the burden relative to the pallet, the burden will slide from the pallet into the hopper 99. Accordingly, the degree of the pivotal angle can be modified by the depth of the depressed portion 87 of the trackway.

As the rear wheels of pallet 9e follow the upwardly curving portion of the trackway 89, the pallet 9e begins to pivot upwardly toward the continuous side walls 35 and 37. The support rail 95 has terminated to allow the rear wheels of pallet 9e to return to the same horizontal plane as its forward wheels 19. Finally, the pallet 9f is completely returned to the horizontal plane of trackway 17 and the sealing means 65 between the side walls and upper pallet surface has been reestablished. The third sealing means 80 between the windboxes and the lower surface of the pallet is reestablished in the charging zone prior to the pallets entering the false windboxes.

Again, as the pallets return to the horizontal, the leading edge of the pallet does not rise above the horizontal plane of the grate surface. The leading face of pallet 9e mates with the trailing face 31 of pallet 9f.

Figure 5:
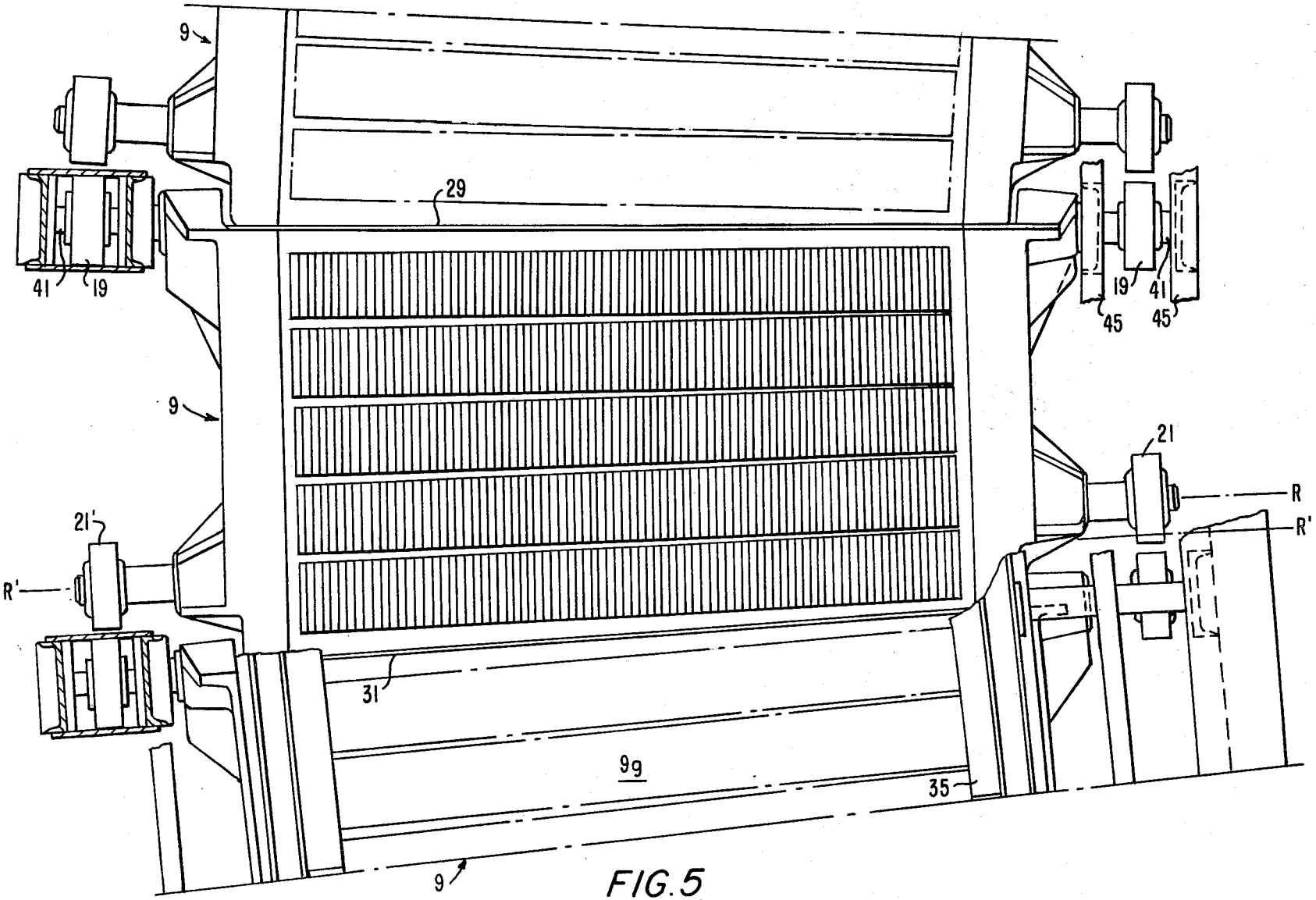
FIG. 5 is a plan view of three traveling grate pallets with portions cut away.

A preferred feature of the pallet can now be explained. The plan view of the pallets in FIG. 5 show that the forward wheels 19 of center pallet 9 are mounted on a common forward lateral axis 41. However, the rear wheels 21 and 21' do not share a common axis. Because the pallets are in the shape of a truncated sector and the leading wheels of the next following pallet 9g extend out forwardly therefrom, the rear wheels 21 are positioned to maximize the support provided to the pallet and the burden carried thereon. Thus each rear wheel is aligned along a separate radius R and $R^1$ of the horizontally disposed trackway 17. Because the rear wheels are mounted along separate radii, the depressed portion of the trackway 87 must be adjusted to permit the rear wheels to follow its downward path without generating any twisting moment in the pallet as it pivots by means of the forward axles 41. Accordingly, the outer rail would also be slightly lower than the inner rail in the discharging zone. Since the outer rear wheel is aligned on a radius $R^1$ which trails that radius R along which the inner rear wheel is aligned by a predetermined number of degrees, the beginning and end of the depressions in the two rails must be staggered slightly in the horizontal direction. The outside rail must begin and end the depression early by an amount equal to the angular distance between R and $R^1$. As a result both rear wheels of a pallet travel along the depressed rail section at the same instant and lateral twisting of the pallet is avoided.

Figure 7:
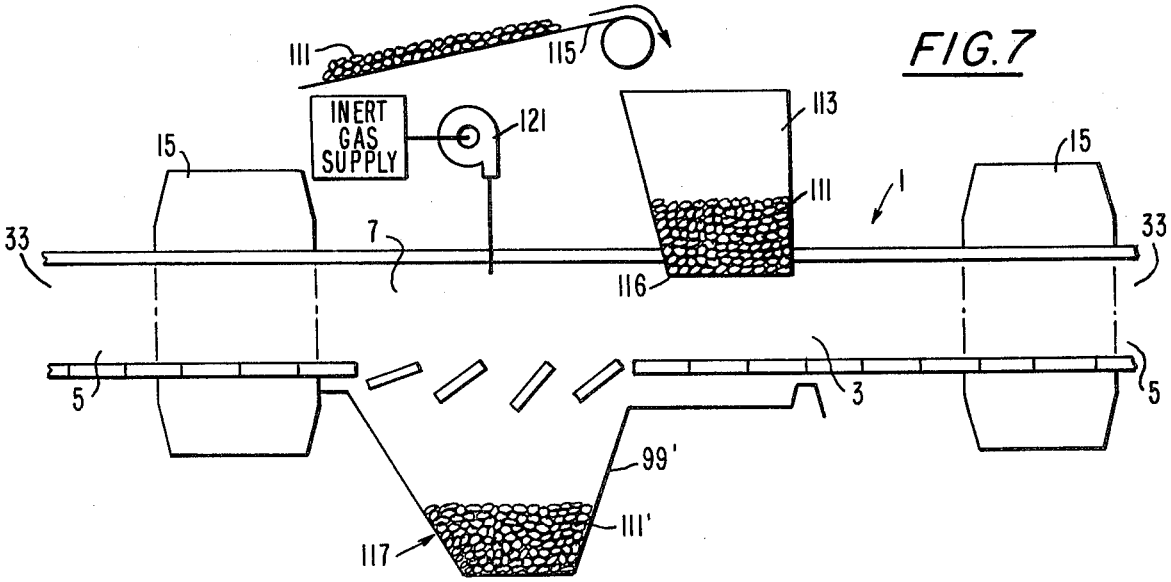
FIG. 7 is a somewhat schematical side elevation of the charging and discharging zones of this invention.

The charging and discharging zones of the traveling grate of this invention are shown in FIG. 7. As previously explained, the charging and discharging zones are in fluid communication with the tunnel 33 and the resulting tunnel chamber area is filled with an inert gas maintained at a pressure greater than the pressure of the fluid being utilized in the processing zone 5. Accordingly, the charging and discharging zones must be isolated from the surrounding atmosphere and the processing zone 5. Transverse seals formed by false windboxes 15 inhibit fluid flow from the processing zone into the discharging and charging zones and seals formed in the charging and discharging hoppers isolate the charging and discharging zones from the environment.

In the charging zone 3, bulk material 111 is continuously fed into a feed chute 113 by an endless belt conveyor 115 or the like. A constant level of bulk material 111 is maintained in the feed chute so that the bulk material forms a seal, as at 116 which isolates the charging zone 3 from the environment surrounding the retort 1. Similarly, the discharging zone 7 is isolated from the environment by maintaining a constant level of bulk material 111' within the discharge hopper 99 in order to form a seal 117 therein. A negative pressure is maintained in the bulk material feeding both the feed chute and the discharge hopper to ensure an in-leakage of outside air which is used in the process and to consequently prevent an out-leakage of process gas. Suitable means are then provided for the disposal of the discharged burden 111'. The charging and discharging zones 3 and 7 respectively are in fluid communication with one another and the tunnels 33. Means, such as a blower 121 which is in communication with an inert gas supply are provided to maintain pressure within the tunnels 33 at a higher level than the pressure within the processing zone 5 so that any fluid leakage is from the zone 33 into the processing zone 5.

Because of the unique configuration of the present horizontally disposed circular traveling grate machine, the moving components of the pallets are protected from the harsh environment of the processing zone, process gas leakage is minimized and the processed materials can be readily discharged from the retorts traveling grate.

I claim:

1. A continuous traveling grate machine on which a burden is transported from a charging zone to a discharging zone for treatment in a processing zone therebetween by a process requiring minimum gas leakage of processing gas which is maintained at a predetermined pressure, said machine comprising:

a pair of substantially continuous rails defining a generally horizontal circular trackway;

a plurality of individual pallets, each of which is supported on a pair of forward and a pair of rear laterally disposed wheels which ride along said rails;

a plurality of hoods disposed above said pallets;

a plurality of windboxes disposed below said rails a portion of said windboxes and hoods defining said processing zone;

a charging hopper defining said charging zone through which a burden is charged onto said pallets, said burden maintaining a gas seal in said hopper;

a discharging hopper defining said discharge zone in which said burden is removed from said pallets, said hopper including means to at least in part provide a gas seal in said discharging hopper;

transverse sealing means substantially isolating said processing zone from said charging and discharging zones, each of said transverse sealing mean consisting of one of said hoods and one of said windboxes substantially vertically aligned and through which an inert gas is conveyed at a pressure greater than the predetermined pressure in the adjacent processing zone;

longitudinal sealing means substantially isolating said wheels from said processing zone and defining a tunnel through which said pallet wheels travel when transversing said processing zone, said tunnel being in fluid communication with said charging and discharging zone and having therein an inert gas maintained at a pressure greater than said predetermined pressure such that any gas leakage between said tunnel and said processing zone is from the former into the latter and said pallet wheels are substantially protected from contact with the processing gas during travel along said rails.

2. The apparatus according to claim 1 including continuous side walls extending between the pallets and the hoods, said side walls having a bottom face which together with the surface of the pallet forms a seal therebetween and sealing means between said continuous side walls and said hoods and sealing means between the windboxes and the bottom face of each of said pallets whereby said seals substantially retain the flow of process gas within the process zone.

3. The apparatus of claim 2 wherein the sealing means between the windboxes and the pallets, the sealing means between the side walls and the hoods, the side wall-pallet seal and an enclosure member extending from the hood to the windbox on the side of the wheels distal the pallets defining the tunnel forming a continuous chamber in fluid communication with the discharging and charging zones.

4. The apparatus of claim 3 wherein two of the wheels supporting each pallet define the forward wheels thereof and wherein the continuous side walls are supported by said forward wheels whereby the plurality of pallets and the continuous side walls travel about the trackway as an integral unit.

5. The apparatus of claim 4 wherein each of the pallets is individually pivotable about its forward wheels, and wherein the pair of rails defining the circular trackway is in a horizontal plane in the processing zone and in the charging zone and said pair of rails defines a depressed trackway below said horizontal plane in said discharge zone and wherein the seal between the windboxes and the pallets is discontinued in the discharging zone whereby as each of said pallets travels through the discharge zone, the rear wheels thereof follow the depressed trackway causing the pallet to pivot about its forward wheels and fall away from the bottom faces of the continuous side walls and as each of said pallets travels out of the discharge zone the rear wheels thereof follow the depressed trackway as it returns to the horizontal plane and lift the pallet so that the pallet pivots back into contact with the bottom faces of the continuous side walls.

6. The apparatus of claim 5 including a pair of forward wheel support rails in the horizontal plane of the trackway in the discharging zone, said support rails providing a partial trackway which supports each pallet's forward wheels for a portion of the period during which the pallet's rear wheels travel along the depressed trackway.

7. The apparatus of claim 1 wherein each of the plurality of individual pallets comprises a platform, a portion of which is gas permeable, having an inner and outer side, a front and rear face, and an upper and lower surface wherein said forward face is generally rearwardly angled from said upper surface to said lower surface and wherein said pallet includes a forward axle extending laterally from said inner and outer sides to support the forward pair of wheels and wherein an inner continuous side wall and an outer continuous side wall extending between the pallets and the hoods are supported by said forward lateral axle and said forward pair of wheels through at least the charging and processing zones of the traveling grate machine and wherein the pair of rails defining the circular trackway is in a horizontal plane in the processing and charging zones and defines a depressed trackway portion below said horizontal plane in said discharge zone whereby as each of said pallets travels through the discharge zone, the rear wheels thereof follow the depressed trackway causing the pallet to pivot about its forward wheels now being supported by said continuous sidewalls and fall away from said side walls and as the pallet travels out of the discharge zone, the rear wheels thereof follow the depressed trackway as it returns to the horizontal plane and lift the pallot so that the pallot pivots back into its horizontal disposition on the trackway of the grate machine.

8. The apparatus of claim 7 wherein the upper surface of each pallet and the bottom edge of each continuous side wall are continguous and form a mechanical seal therebetween and wherein the front face of each pallet is no farther forward than the centerline of the forward lateral axle thereof and the lower surface of the pallet is no lower than said centerline whereby each pallet falls away from the bottom of each side wall without experiencing any upward lift relative to said side walls.

9. A continuous traveling grate machine on which a burden is transported from a charging zone to a discharging zone for treatment in a processing zone therebetween comprising:

a pair of substantially continuous rails defining a circular trackway through a horizontal plane in the processing zone and the charging zone and a trackway depressed below said horizontal plane in the discharging zone;

a plurality of individual pallets each of which comprises:

a gas permeable platform having an inner and an outer side, a front and a rear face, and an upper and lower surface each of said surfaces having a leading edge and a trailing edge, with said forward face being generally rearwardly angled from said upper surface to said lower surface, a forward lateral axle, at least one rear lateral axle and four wheels mounted for rotation about said axles for travel along said trackway with the distance from the forward lateral axle of a first pallet to the forward face of the next following pallet being no less than the distance from the forward lateral axle of the first pallet to the trailing edge of the upper surface of the first pallet; and an inner continuous side wall and an outer continuous side wall supported by said forward axles and wheels and together with the upper surface of said pallets defining a burden confining area, said side walls being generally contiguous with and extending from the upper surface of said pallets and together therewith traveling through said zones; each of said pallets being individually mounted to said side walls by said forward axles for pivotal movement relative thereto, whereby as each pallet travels through said discharging zone the rear wheels of the pallet follow the depressed trackway causing the pallet to pivot downwardly about the forward lateral axle and as the pallet travels out of the discharging zone the rear wheels follow the trackway as it returns to said horizontal plane causing the pallet to pivot upwardly, back toward said continuous side walls for travel in said horizontal plane.

10. The apparatus of claim 9 wherein the front face of each pallet is no farther forward than the centerline of the forward lateral axis whereby each pallet falls away from the bottom of each side wall without experiencing any upward lift relative to said side walls.

* * * * *